US006467443B1

(12) United States Patent
Tsuruta et al.

(10) Patent No.: US 6,467,443 B1
(45) Date of Patent: Oct. 22, 2002

(54) VALVE OPERATING DEVICE OF INTERNAL COMBUSTION ENGINE

(75) Inventors: Seiji Tsuruta, Kanagawa (JP); Nobutaka Hayashi, Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/708,413

(22) Filed: Nov. 9, 2000

(30) Foreign Application Priority Data

Nov. 29, 1999 (JP) ..... 11-338017

(51) Int. Cl.[7] ..... F01L 1/34

(52) U.S. Cl. ..... 123/90.16; 123/90.12; 123/90.22; 123/90.4; 123/90.44

(58) Field of Search ..... 123/90.16, 90.15, 123/90.17, 90.12, 90.22, 90.27, 90.36, 90.39, 90.4, 90.41, 90.44, 90.46, 90.55

(56) References Cited

U.S. PATENT DOCUMENTS 4,151,817 A * 5/1979 Mueller ..... 123/90.16
4,203,397 A * 5/1980 Soeters, Jr. ..... 123/90.16
4,220,122 A * 9/1980 Aoyama ..... 123/90.55
4,768,467 A * 9/1988 Yamada et al. ..... 123/90.16
5,445,116 A * 8/1995 Hara ..... 123/90.16
5,452,694 A * 9/1995 Hara ..... 123/90.16
5,622,145 A * 4/1997 Hara ..... 123/90.16
RE35,662 E * 11/1997 Murata et al. ..... 123/90.16
5,692,465 A * 12/1997 Sawada et al. ..... 123/90.16
5,794,576 A * 8/1998 Hara et al. ..... 123/90.16
5,975,036 A * 11/1999 Hayashi et al. ..... 123/90.16
6,032,624 A * 3/2000 Tsuruta et al. ..... 123/90.16

* cited by examiner

*Primary Examiner*—Teresa Walberg
*Assistant Examiner*—Fadi H. Dahbour
(74) *Attorney, Agent, or Firm*—Foley & Lardner

(57) ABSTRACT

A low speed cam is disposed on a cam shaft. A low speed sub-rocker arm actuated by the low speed cam is pivotally connected to a main rocker arm. A connecting member is supported by the main rocker arm. The connecting member has both a first condition wherein the sub-rocker arm and the main rocker arm are fixed to each other to constitute a single unit and a second condition wherein the sub-rocker arm and the main rocker arm are disengaged from each other. A hydraulically actuating mechanism has a hydraulic work chamber. The mechanism induces the first condition of the connecting member upon discharge of hydraulic fluid from the work chamber and induces the second condition upon feeding of hydraulic fluid to the work chamber. A control unit causes the hydraulically actuating mechanism to induce the first condition of the connecting member when the engine stops.

18 Claims, 7 Drawing Sheets

VALVE OPERATING DEVICE OF INTERNAL COMBUSTION ENGINE

BACKGROUND OF THE INVENTION

1. Field of the Invention

The present invention relates in general to valve operating devices of internal combustion engine, and more particularly to the valve operating devices of a type wherein the valve lifting is controlled in accordance with the operating condition of the engine.

2. Description of Related Art

In order to clarify the task of the present invention, one related valve operating device of the above-mentioned type will be briefly described in the following, which is shown in Japanese Utility Model First Provisional Publication 6-73301.

In the device, low speed cams used for all operation ranges of the engine are mounted on a cam shaft. Each low speed cam slidably contacts a main rocker arm to actuate intake or exhaust valves. The main rocker arm is pivotally mounted on a rocker shaft. Beside the low speed cam, medium speed and high speed cams are also mounted on the cam shaft, which are used for middle and high speed operation ranges of the engine respectively. The medium and high speed cams slidably contact respective sub-locker arms which are pivotally mounted on the rocker shaft beside the above-mentioned locker arm. During operation of the engine, the two sub-rocker arms are selectively fixed to the main locker arm by means of a switching mechanism.

The switching mechanism comprises generally two connecting levers which are pivotally connected to the main rocker arm. One of the connecting levers is operated for fixing one of sub-rocker arms to the main rocker arm, and the other connecting lever is operated for fixing the other sub-rocker arm to the main rocker arm. Thus, when one of the sub-rocker arms is fixed to the main rocker arm, these two rocker arms constitute a single unit which is pivotally actuated by selected one of the medium and high speed cams that actually contacts a cam follower of the sub-rocker arm. Thus, in this case, the opening/closing operation of the intake or exhaust valves is timed by the selected one of the medium and high speed cams.

In the multi-cylinder internal combustion engines, for reducing a pumping loss at the time of a low load operation, various measures have been hitherto proposed and put into practical use. One of them is shown in Japanese Patent First Provisional Publication 5-248215. In the pumping loss reduction measure of this publication, the intake and/or exhaust valves of given cylinders are made inoperative under a low load operation of the engine. For making the intake and exhaust valves inoperative, the publication discloses an arrangement wherein a sub-rocker arm can be selectively fixed to a rocker shaft to which a main rocker arm for operating the intake or exhaust valves is fixed and wherein a hydraulically actuated connecting plunger for fixing the two rocker arms is slidably received in a receiving hole formed in the rocker shaft. When the connecting plunger is disengaged from the sub-rocker arm, the sub-rocker arm becomes pivotal relative to the main rocker arm, and thus the pivoting movement of the sub-rocker arm induced by rotation of an associated cam does not induce the pivoting movement of the main rocker arm. Thus, in this case, the intake valves and/or the exhaust valves of the given cylinders are forced to take their rest condition even under operation of the engine, which reduces the pumping loss of the engine. In the disclosed measure of the publication, in order to disengage the connecting plunger from the sub-rocker arm, it is needed to stop feeding of hydraulic pressure to a hydraulic work chamber for the connecting plunger. Upon stopping of the pressure feeding, the connecting plunger is retracted into the receiving hole of the rocker shaft due to a biasing force of a coil spring.

SUMMARY OF THE INVENTION

In the arrangement of the publication 5-248215, for engaging the connecting plunger with the sub-rocker arm, it is needed to feed the hydraulic pressure to the hydraulic work chamber for the connecting plunger. However, due to inherent construction of the arrangement, feeding of sufficient hydraulic pressure to the hydraulic work chamber is not quickly carried out, especially in winter. Thus, upon restarting of the engine, it tends to occur that the intake and/or exhaust valves of the certain cylinders keep the rest condition for a certain time, which induces a non-smoothed engine starting.

It is therefore an object of the present invention to provide a valve operating device of an internal combustion engine, which can provide the engine with a smoothed engine starting even when the engine was subjected to the pumping loss reduction operation before engine stopping.

According to a first aspect of the present invention, there is provided a valve operating device of an internal combustion engine, which comprises low and high speed cams coaxially disposed on a cam shaft, the low speed cam having a lobe that is lower than that of the high speed cam; a main rocker arm pivotally supported by a rocker shaft and operatively contacting an intake or exhaust valve of the engine to actuate the same; first and second sub-rocker arms pivotally supported by the main rocker arm and pivotally actuated by the low and high speed cams respectively; a connecting member supported by the main rocker arm, the connecting member comprising first and second engaging portions which are respectively engageable with first and second engaged portions defined by the first and second sub-rocker arms, so that upon engagement of the first engaging portion with the first engaged portion, the first sub-rocker arm and the main rocker arm become fixed to each other to pivot about the rocker shaft like a single unit, and upon engagement of the second engaging portion with the second engaged portion, the second sub-rocker arm and the main rocker arm become fixed to each other to pivot about the rocker shaft like a single unit; a hydraulically actuating mechanism comprising first and second hydraulic work chambers, the mechanism inducing the engagement between the first engaging portion and the first engaged portion upon discharge of hydraulic fluid from the first work chamber and inducing a disengagement between the first engaging portion and the first engaged portion upon feeding of the hydraulic fluid into the first work chamber, and the mechanism selectively inducing the engagement or disengagement between the second engaging portion and the second engaged portion in accordance with a pressure of hydraulic fluid fed to the second work chamber; a hydraulic pressure producing unit that feeds the first and second work chambers with hydraulic pressure respectively; and a control unit that, in accordance with operation condition of the engine, controls the hydraulic pressure producing unit, so that the hydraulically actuating mechanism has at least first, second and third operation modes, the first mode being a mode wherein disengagement takes place both between the first engaging portion and the first engaged portion and between the second engaging portion and the second disengaged portion, the second mode being a mode wherein engagement takes place between the first engaging portion and the first engaged portion and disengagement takes place between the second engaging portion and the second engaged portion, the third mode being a mode wherein engagement takes place both between the first engaging portion and the first engaged portion and between the second engaging portion and the second engaged potion.

According to a second aspect of the present invention, there is provided a valve operating device of an internal combustion engine, which comprises a plurality of cams coaxially disposed on a cam shaft, one of the cam being a low speed cam; a rocker arm pivotally supported by a rocker shaft and operatively contacting an intake or exhaust valve of the engine to actuate the same; a sub-rocker arm pivotally supported by the rocker shaft and pivotally actuated by the low speed cam; a connecting member supported by the main rocker arm, the connecting member having both a first condition wherein the sub-rocker arm and the main rocker arm are fixed to each other to constitute a single unit and a second condition wherein the sub-rocker arm and the main rocker arm are disengaged from each other; a hydraulically actuating mechanism including a hydraulic work chamber, the mechanism inducing the first condition of the connecting member upon discharge of hydraulic fluid from the work chamber and inducing the second condition upon feeding of hydraulic fluid to the work chamber; and a control unit that causes the hydraulically actuating mechanism to induce the first condition of the connecting member when the engine stops.

According to a third aspect of the present invention, there is provided a valve operating device of an internal combustion engine, which comprises at least one cam disposed on a cam shaft; a rocker arm pivotally supported by a rocker shaft and operatively contacting an intake or exhaust valve of a cylinder of the engine to actuate the same; a sub-rocker arm pivotally supported by the main rocker arm and pivotally actuated by the cam; a connecting member supported by the main rocker arm, the connecting member having both a first condition wherein the sub-rocker arm and the main rocker arm are fixed to each other to pivot about the rocker shaft like a single unit and a second condition wherein the sub-rocker arm and the main rocker arm are disengaged from each other to fail to transmit a pivotal movement of the sub-rocker arm induced by rotation of the cam to the main rocker arm thereby to stop operation of the intake or exhaust valve; a hydraulically actuating mechanism including a hydraulic work chamber, the mechanism inducing the first condition of the connecting member upon discharge of hydraulic fluid from the work chamber and inducing the second condition upon feeding of hydraulic fluid to the work chamber; and a control unit that causes the hydraulic actuating mechanism to induce the first condition of the connecting member when the engine stops.

The other objects and features of this invention will become understood from the following description with reference to the accompanying drawings.

DETAILED DESCRIPTION OF THE INVENTION

In the following, the valve operation device of the present invention will be described in detail with reference to the accompanying drawings. For ease of understanding of the invention, various directional terms, such as, upper, lower, right, left, upward, downward, clockwise, cunterclockwise and the like will be used in the description. However, such terms are to be understood with respect to a drawing or drawings on which the corresponding part and portion are illustrated.

Figure 2:
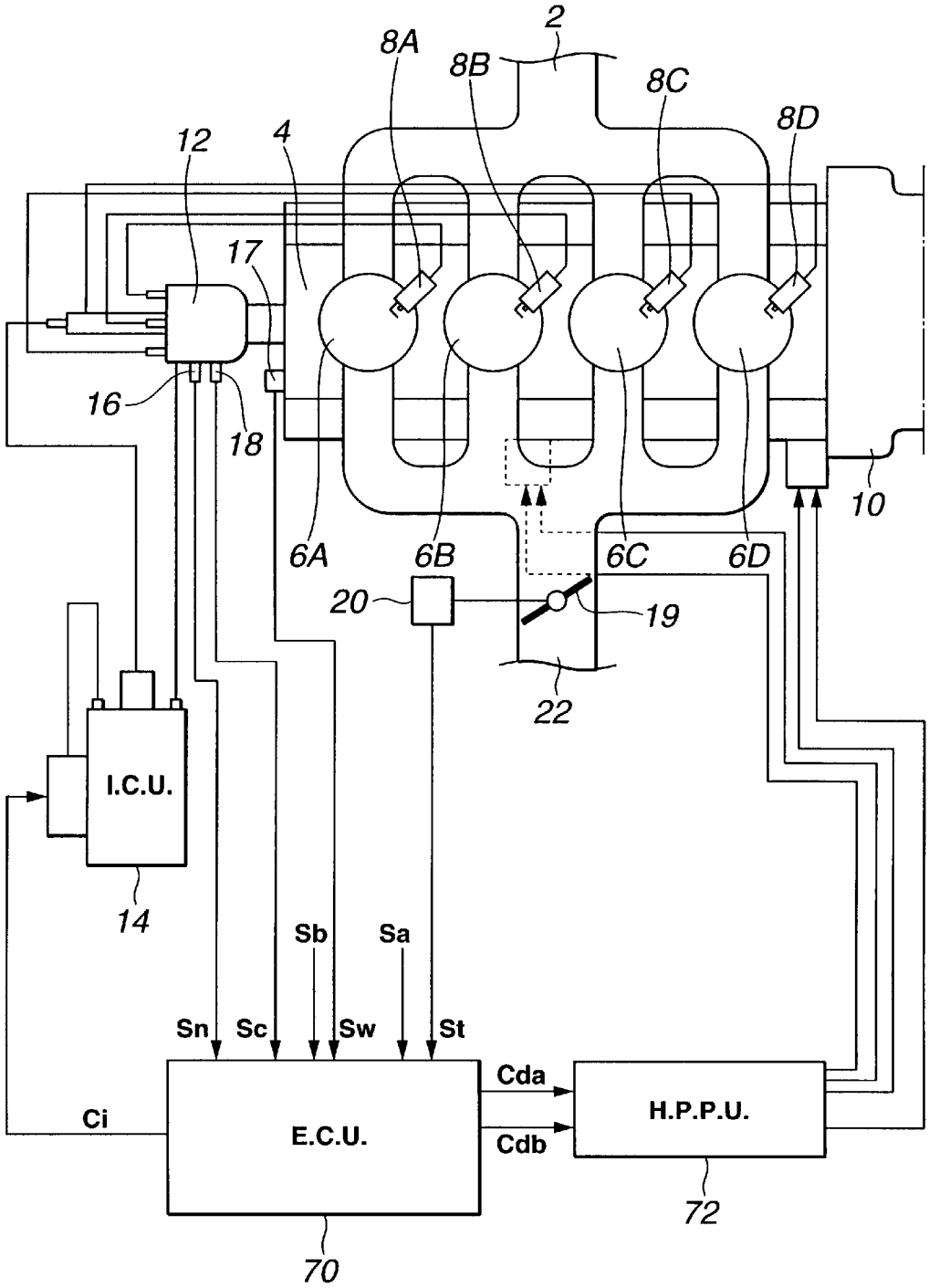
FIG. 2 is a schematic view of an internal combustion engine to which the valve operating device of the invention is practically applied.

Referring to FIG. 2, there is schematically shown an internal combustion engine to which a valve operating device of the present invention is practically applied.

In the drawing, denoted by numeral 4 is an in-line four cylinder type internal combustion engine. That is, the engine 4 has four cylinders 6A, 6B, 6C and 6D which are aligned. The cylinders 6A, 6B, 6C and 6D have ignition plugs 8A, 8B, 8C and 8D respectively. Air intake sides of the four cylinders 6A, 6B, 6C and 6D are respectively connected to four branched passages of an intake passage 22 which has a throttle valve 19 installed in an upstream part thereof. That is, an air/fuel mixture created in the intake passage 22 is fed to the four cylinders 6A, 6B, 6C and 6D through the corresponding four branched passages. The air/fuel mixture fed to each cylinder 6A, 6B, 6C or 6D is combusted due to operation of an ignition system that includes the ignition plugs 8A, 8B, 8C and 8D, a distributor 12 and an ignition control unit 14. The ignition control unit 14 includes an ignition coil. The ignition order of the cylinders 6A, 6B, 6C and 6D is, for example, 6A→6C→6B→6D. Due to combustion of the air/fuel mixture, combustion gas is created in each cylinder 6A, 6B, 6C or 6D. The combustion gas is discharged from each cylinder, as an exhaust gas, to an exhaust passage 2 through a corresponding branched passage of the exhaust passage 2.

At an output side of the engine 4, there is mounted a transmission 10 which inputs an engine power from a crankshaft of the engine 4.

Figure 3:
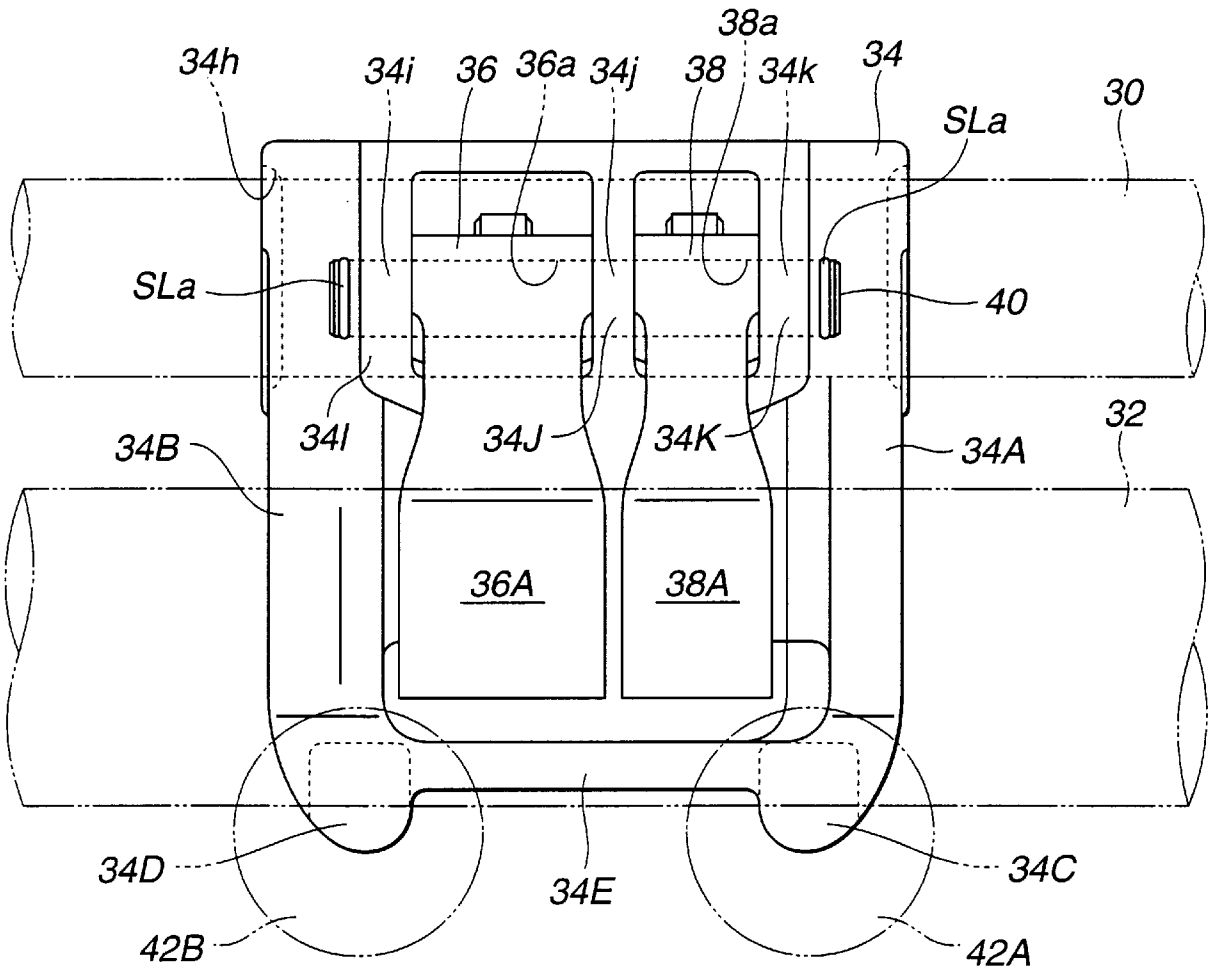
FIG. 3 is a plan view of the unit of the valve operating device of the present invention, which is incorporated with the two intake valves.
Figure 4:
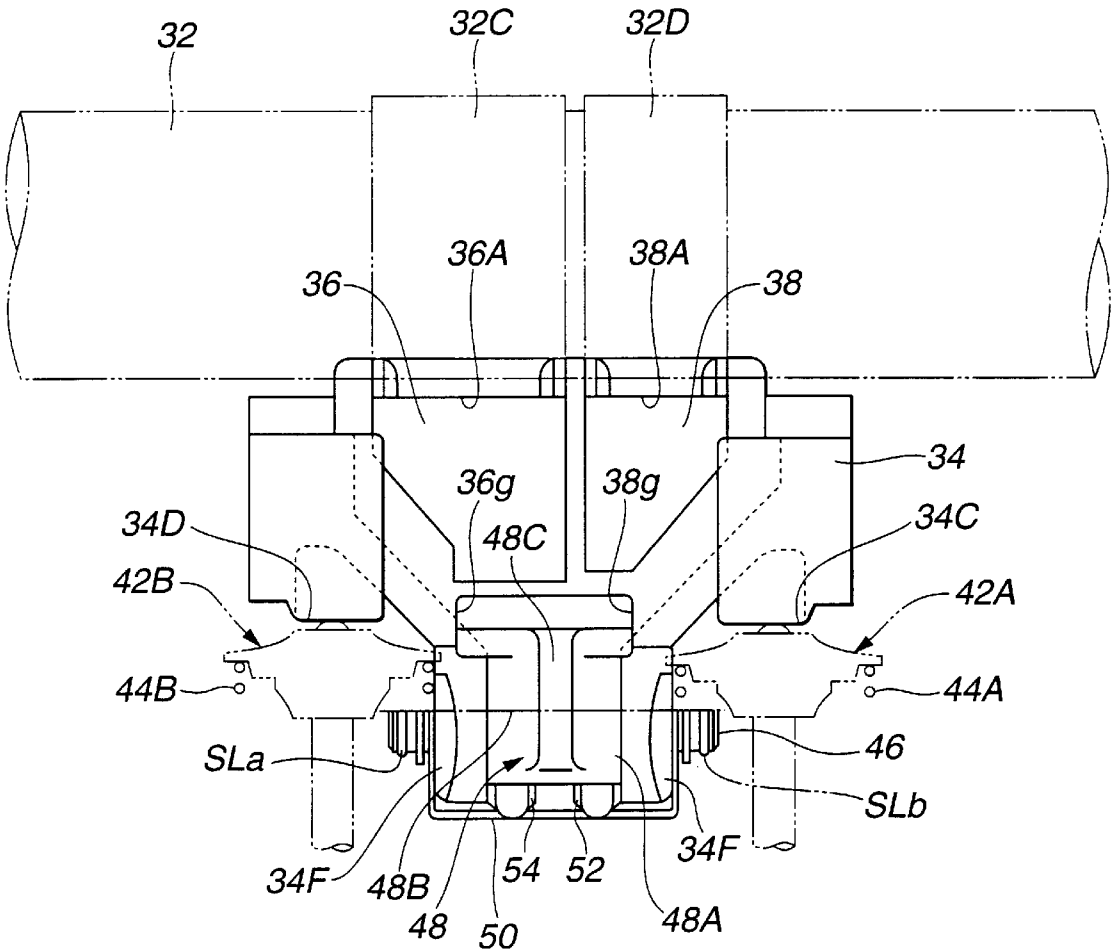
FIG. 4 is a front view of the unit of the valve operating device of the present invention.

Referring to FIGS. 3 and 4, there is shown one unit of the valve operating device of the present invention. In the illustrated embodiment, the unit is incorporated with one of the four cylinders 6A, 6B, 6C and 6D to actuate two intake valves 42A and 42B of the cylinder. It is to be noted that exhaust valves of the cylinder is actuated by another unit which is substantially the same in construction as the unit for the intake valves. In the illustrated embodiment, a so-called "over head camshaft" system (viz., OHC) is employed by the engine 4 for driving the two intake valves.

The valve operating device comprises a main rocker arm 34 that is pivotally supported by a rocker shaft 30 through a hole 34*h* formed therethrough. The main rocker arm 34 is formed with two arm portions 34A and 34B that are contactable with respective ends of valve stems of the two intake valves 42A and 42B. Between the two arm portions 34A and 34B of the main rocker arm 34, there are pivotally arranged two sub-rocker arms 36 and 38.

For ease of understanding, in the following description, these two sub-rocker arms 36 and 38 will be referred to as high and low speed sub-rocker arms respectively.

Above the main rocker arm 34 and the high and low speed sub-rocker arms 36 and 38, there is arranged a cam shaft 32 which extends in parallel with the rocker shaft 30. The cam shaft 32 is rotated about its axis in response to rotation of the crankshaft of the engine 4. That is, the valve operating device comprises generally the main rocker arm 34, the high and low speed sub-rocker arms 36 and 38 and the cam shaft 32.

The main rocker arm 34 has at its base portion a through hole 34*h* through which the rocker shaft 30 passes. With this, the main rocker arm 34 is pivotally supported by the rocker shaft 30. The rocker shaft 30 has both ends tightly held by a cylinder head (not shown) of the engine 4.

As is seen from FIG. 3, the main rocker arm 34 is formed near the through hole 34*h* with three bearing portions 34I, 34J and 34K which are spaced from one another. These bearing portions 34I, 34J and 34K are formed with aligned bores 34I, 34*j* and 34*k* through which a supporting shaft 40 passes. Between the bearing portions 34I and 34J, there is arranged a base portion of the high speed sub-rocker arm 36, and between the bearing portions 34J and 34K, there is arranged a base portion of the low speed sub-rocker arm 38. The base portions of the high and low speed sub-rocker arms 36 and 38 are respectively formed with bearing holes 36*a* and 36*b* (see FIGS. 5 and 1) through which the supporting shaft 40 passes. Both ends of the supporting shaft 40 are held by the bearing portions 34I and 34K through respective retainer rings Sla and Sla fitted to the ends.

Leading end portions of the two arm portions 34A and 34B of the main rocker arm 34 are formed, at portions thereof facing the intake valves 42A and 42B, with respective contacting portions 34C and 34D which are contactable with the upper ends of the valve stems of the intake valves 42A and 42B. The leading end portions of the two arm portions 34A and 34B are integrally connected through a connecting portion 34E.

As is seen from FIG. 4, the intake valves 42A and 42B are biased toward the contacting portions 34C and 34D of the main rocker arm 34 by respective coil springs 44A and 44B. Each coil spring 44A or 44B is held by a retainer fixed to an end of the valve stem.

Figure 1:
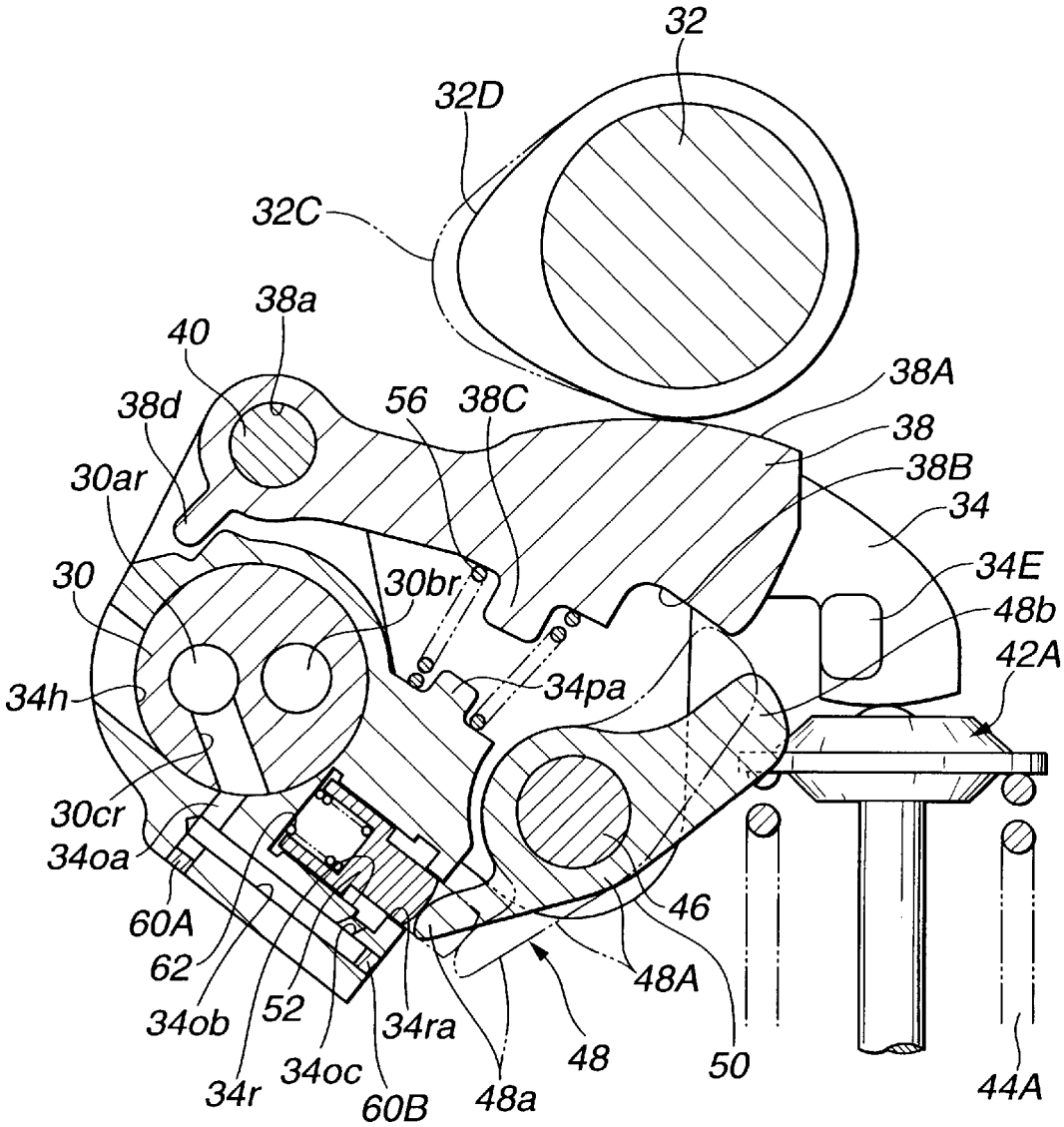
FIG. 1 is a sectional view of one unit of a valve operating device according to the present invention, showing parts and portions that are incorporated with a low speed cam.

As is seen from FIGS. 1 and 4, the low speed sub-rocker arm 38 is formed, at an upper surface thereof facing the cam shaft 32, with a cam follower 38A which slidably contacts a low speed cam 32D tightly disposed on the cam shaft 32. The low speed sub-rocker arm 38 is further formed, at a lower surface thereof, with a recess 38B to which an engaging portion 48A of an after-mentioned connecting lever 48 is engageable.

As is seen from FIG. 4, the recess 38B is formed with a wall 38g that extends perpendicular to the axis of the supporting shaft 40 and faces leftward in the drawing, that is, toward the high speed sub-rocker arm 36.

As is seen from FIG. 1, the low speed sub-rocker arm 38 is formed at its lower surface with a projection 38C which holds an upper end of a coil spring 56 which is operatively interposed between the main rocker arm 34 and the low speed sub-rocker arm 38. A lower end of the coil spring 56 is held by a projection 34*pa* formed on the main rocker arm 34. With the force of the coil spring 56, the low speed sub-rocker arm 38 is biased toward the cam shaft 32, that is, biased to pivot in a counterclockwise direction in FIG. 1.

It is to be noted that the coil spring 56 is arranged between the main rocker arm 34 and the low speed sub-rocker arm 38 without using a conventionally used spring holder that is to be received in the main rocker arm 34. This means that in the illustrated embodiment, there is no need of worrying about a friction inevitably produced between the spring holder and the internal wall of the main rocker arm 34. Furthermore, such simple arrangement of the coil spring 56 between the two rocker arms 34 and 38 brings about reduction in number of parts and simplification in machining the rocker arms 34 and 38. Furthermore, when the two projections 38C and 34pa are arranged to contact each other, the coil spring 56 is protected from being applied with an undesirable shearing force.

As is seen from FIG. 1, the low speed sub-rocker arm 38 is formed at the base portion thereof with a projection 38*d* that extends downward. The main rocker arm 34 is formed near the through hole 34*h* with a stepped portion (no numeral). The projection 38*d* of the low speed sub-rocker arm 38 is able to abut against the stepped portion of the main rocker arm 34, and thus excessive upward pivoting of the low speed sub-rocker arm 38 relative to the main rocker arm 34 is suppressed.

Figure 5:
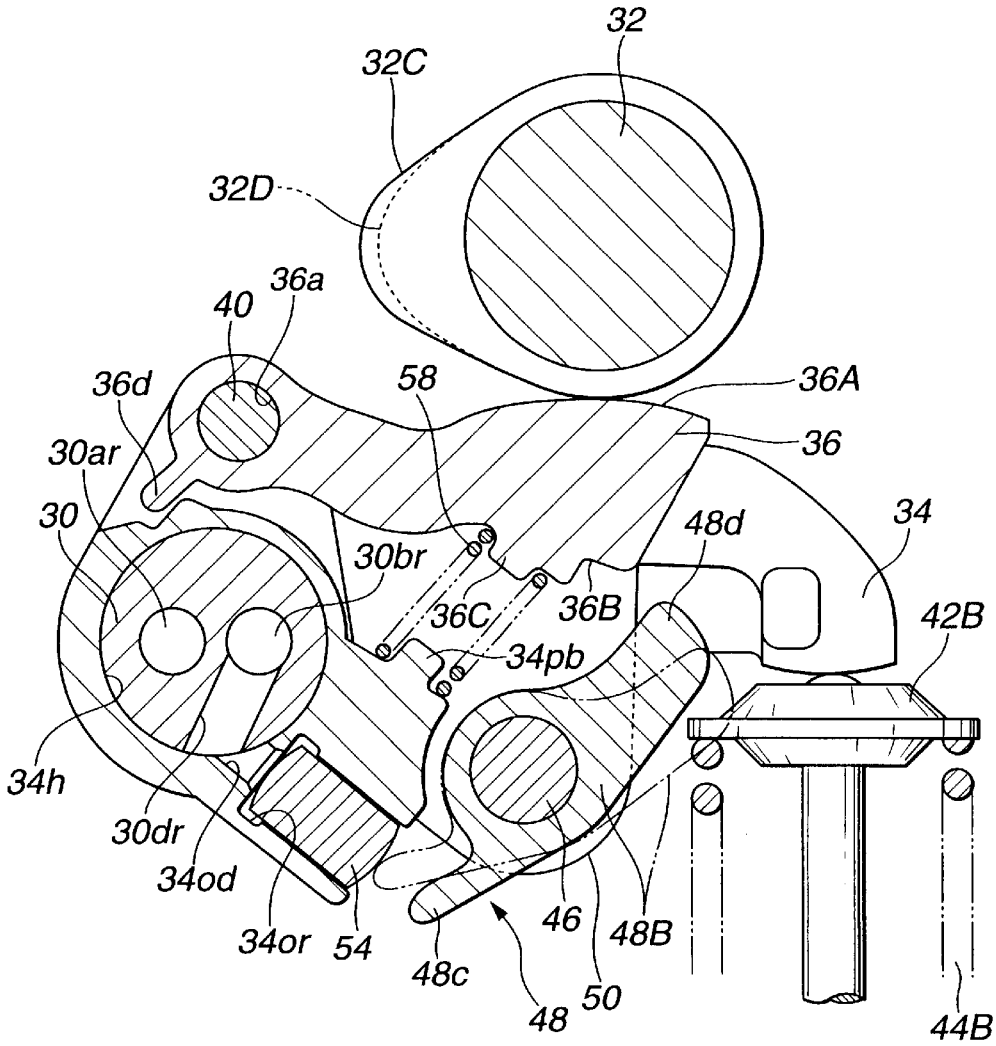
FIG. 5 is a view similar to FIG. 1, but showing parts and portions that are incorporated with a high speed cam.

As is seen from FIGS. 4 and 5, the high speed sub-rocker arm 36 is formed, at an upper surface thereof facing the cam shaft 32, with a cam follower 36A which slidably contacts a high speed cam 32C tightly disposed on the cam shaft 32. The high speed sub-rocker arm 36 is further formed, at a lower surface thereof, with a recess 36B to which an engaging portion 48B of the next-mentioned connecting lever 48 is engageable.

Thus, it is to be noted that the connecting lever 48 has two engaging portions, which are, the engaging portion 48A which is engageable with the recess 38B of the low speed sub-rocker arm 38 and the engaging portion 48B which is engageable with the recess 36B of the high speed sub-rocker arm 36. This arrangement will be well seen from FIG. 4. As will be understood when comparing FIGS. 1 and 5, the length of the recess 36B measured with respect to the traveling path of the connecting lever 48 is shorter than that of the above-mentioned recess 38B of the low speed sub-rocker arm 38.

As is seen from FIG. 4, the recess 36B of the high speed sub-rocker arm 36 is formed with a wall 36*g* that extends perpendicular to the axis of the supporting shaft 40 and faces rightward in the drawing, that is, toward the wall 38*g* of the recess 38B of the low speed sub-rocker arm 38.

That is, in a rest condition of the low and high speed sub-rocker arms 38 and 36, the respective recesses 38B and 36B face each other.

As is seen from FIG. 5, the high speed sub-rocker arm 36 is formed at its lower surface with a projection 36C which holes an upper end-of a coil spring 58 which is operatively interposed between the main rocker arm 34 and the high speed sub-rocker arm 36. A lower end of the coil spring 58 is held by a projection 34*pb* formed on the main rocker arm 34. With the force of the coil spring 58, the high speed sub-rocker arm 36 is biased toward the cam shaft 32, that is, biased to pivot in a counterclockwise direction in FIG. 5.

It is to be noted that the coil spring 58 is arranged between the main rocker arm 34 and the high speed sub-rocker arm 36 without using a conventionally used spring holder that is to be received in the main rocker arm 34. Thus, there is no need of worrying about a friction inevitably produced between the spring holder and the internal wall of the main rocker arm 34. Furthermore, such simple arrangement of the coil spring 58 between the two rocker arms 34 and 36 brings about reduction in number of parts and simplification in machining the main rocker arms 34 and 36. Furthermore, when the two projections 36C and 34*pb* are arranged to contact each other, the coil spring 58 is protected from being applied with an undesirable shearing force.

As is seen from FIG. 5, the high speed sub-rocker arm 36 is formed at the base portion thereof with a projection 36d that extends downward. The main rocker arm 34 is formed near the through hole 34*h* with a stepped portion (no numeral). The projection 36*d* of the high speed sub-rocker arm 36 is able to abut against the stepped portion of the main rocker arm 34, and thus excessive upward pivoting of the high speed sub-rocker arm 36 relative to the main rocker arm 34 is suppressed.

As is seen from FIGS. 1 and 4, the low speed cam 32D is tightly disposed about the cam shaft 32, which slidably contacts the cam follower 38A to determine the lift degree of the intake valves 42A and 42B when the engine 4 is in a lower speed operation mode.

As is seen from FIGS. 4 and 5, the high speed cam 32C is tightly disposed about the cam shaft 32 beside the low speed cam 32D, which slidably contacts the cam follower 36A to determine the lift degree of the intake valves 42A and 42B when the engine 4 is in a high speed operation mode.

As will become apparent when comparing FIGS. 1 and 5, the maximum eccentricity (viz., lobe) of the low speed cam 32D relative to the axis of the cam shaft 32 is smaller than that of the high speed cam 32C. Although not shown in the drawings, a so-called variable valve open/close timing unit is installed at one end of the cam shaft 32 to adjust the cam face angle of the cam shaft 32.

As is understood from FIGS. 1 and 4, at a lower portion of the main rocker arm 34, that is, below high and low speed sub-rocker arms 36 and 38, there is arranged a supporting shaft 46 which extends in parallel with the cam shaft 32. For supporting the supporting shaft 46, two spaced bearing portions 34F and 34F are formed on the main rocker arm 34. Both ends of the supporting shaft 46 are held by the bearing portions 34F and 34F through respective retainer rings SLa and SLb fitted to the ends.

The connecting lever 48 is pivotally supported by the supporting shaft 46. The connecting lever 48 is integrally formed with two engaging portions, which are the engaging portion 48B which is selectively engageable with the recess 36B of the high speed sub-rocker arm 36 and the engaging portion 48A which is selectively engageable with the recess 38B of the low speed sub-rocker arm 38. These two engaging portions 48A and 48B are spaced from each other in a direction parallel with the axis of the supporting shaft 46.

As will be understood when comparing FIGS. 1 and 5, the engaging portion 48A is arranged nearer to the rocker shaft 30 than the other engaging portion 48B by a predetermined angle which the connecting lever 48 can pivot. Accordingly, when a top end 48*b* of the engaging portion 48A is shifted from a position shown by a solid line in FIG. 1 to an engaging position shown by a phantom line, the other engaging portion 48B is shifted from a position shown by a phantom line in FIG. 5 to a position shown by a solid line. That is, upon counterclockwise pivoting from OFF position in FIGS. 1 and 5, the engaging portion 48A can arrive at ON position faster than the other engaging portion 48B.

As is seen from FIG. 1, the top end 48*b* of the engaging portion 48A is shaped roundly to achieve a smoothed engagement with the recess 38B of the low speed sub-rocker arm 38. Furthermore, as is seen from FIG. 5, a top end 48*d* of the other engaging portion 48B is shaped roundly to achieve a smoothed engagement with the recess 36B of the high speed sub-rocker arm 36.

As is seen from FIG. 4, a return spring 50 is arranged, which has a middle portion engaged with a lower portion of the connecting lever 48 and both ends held by both ends of the supporting shaft 46. With this return spring 50, the connecting lever 48 is biased to pivot in a direction to move the two engaging portions 48A and 48B away from the respective low and high speed sub-rocker arms 38 and 36, that is, in a clockwise direction in FIGS. 1 and 5.

As is seen from FIG. 1, the rocker shaft 30 is formed with two axially extending hydraulic passages 30*ar* and 30*br*. These passages 30*ar* and 30*br* are connected to an after-mentioned hydraulic circuit.

The main rocker arm 34 is formed, at a portion facing the engaging portion 48A of the connecting lever 48, with a hydraulic work chamber 34*r* which is communicated with the hydraulic passage 30*ar* through hydraulic passages 30*cr*, 34*oa*, 34*ob* and 34*oc*. As shown, the work chamber 34*r* is formed near its open end 34*ra* with an annular groove to which the hydraulic passage 34*oc* is exposed. Within the hydraulic work chamber 34*r*, there is slidably received a piston 52. The piston 52 has a shoulder portion to which the hydraulic pressure in the work chamber 34*r* is practically applied. As shown, the exposed end of the piston 52 is rounded. The hydraulic passages 34*oa* and 34*ob* each have an end sealed with a plug member 60A or 60B. One end of the hydraulic passage 34*oc* is connected to a space that is defined between a leading portion of the piston 52 and an inner wall of the hydraulic work chamber 34*r*.

Within a blind bore formed in the piston 52, there is disposed a coil spring 62 which has one end seated on the bottom of the hydraulic work chamber 34*r* and the other end seated on the bottom of the blind bore. With this coil spring 62, the piston 52 is biased rightward in FIG. 1, that is, in a direction in which the leading portion of the piston 52 projects outward through an open end 34*ra*. The biasing force produced by the coil spring 62 is greater than that of the return spring 50 that biases the connecting lever 48. As shown, the leading top of the piston 52 is in contact with a downward projection 48*a* of the engaging portion 48A of the connecting lever 48.

When the hydraulic work chamber 34*r* is fed with a certain hydraulic pressure through the hydraulic passages 30*ar*, 30*cr*, 34*oa*, 34*ob* and 34*oc*, the piston 52 is retracted into the work chamber 34*r* against the force of the coil spring 62 and the leading top of the piston 52 becomes flush with an outer surface of the main rocker arm 34 as is shown in FIG. 1. With this, the connecting lever 48 is permitted to pivot in a clockwise direction in FIG. 1 due to the force of the return spring 50. Upon this, as is shown by a solid line, the engaging portion 48A of the connecting lever 48 is disengaged from the low speed sub-rocker arm 38.

While, when the hydraulic pressure is discharged from the hydraulic work chamber 34*r*, the piston 52 is forced to take its projected position due to the force of the coil spring 62 causing the leading top thereof to largely project from the outer surface of the main rocker arm 34 as is shown by a phantom line in FIG. 1. Thus, in this case, the connecting lever 48 is pivoted in a counterclockwise direction.

As is seen from FIG. 5, the main rocker arm 34 is formed, at a portion facing the engaging portion 48B of the connecting lever 48, with a hydraulic work chamber 34*or* which is communicated with the hydraulic passage 30*br* through hydraulic passages 30*dr* and 34*od*. Within the hydraulic work chamber 34*or*, there is slidably received a piston 54. As shown, the exposed end of the piston 54 is rounded.

Figure 7:
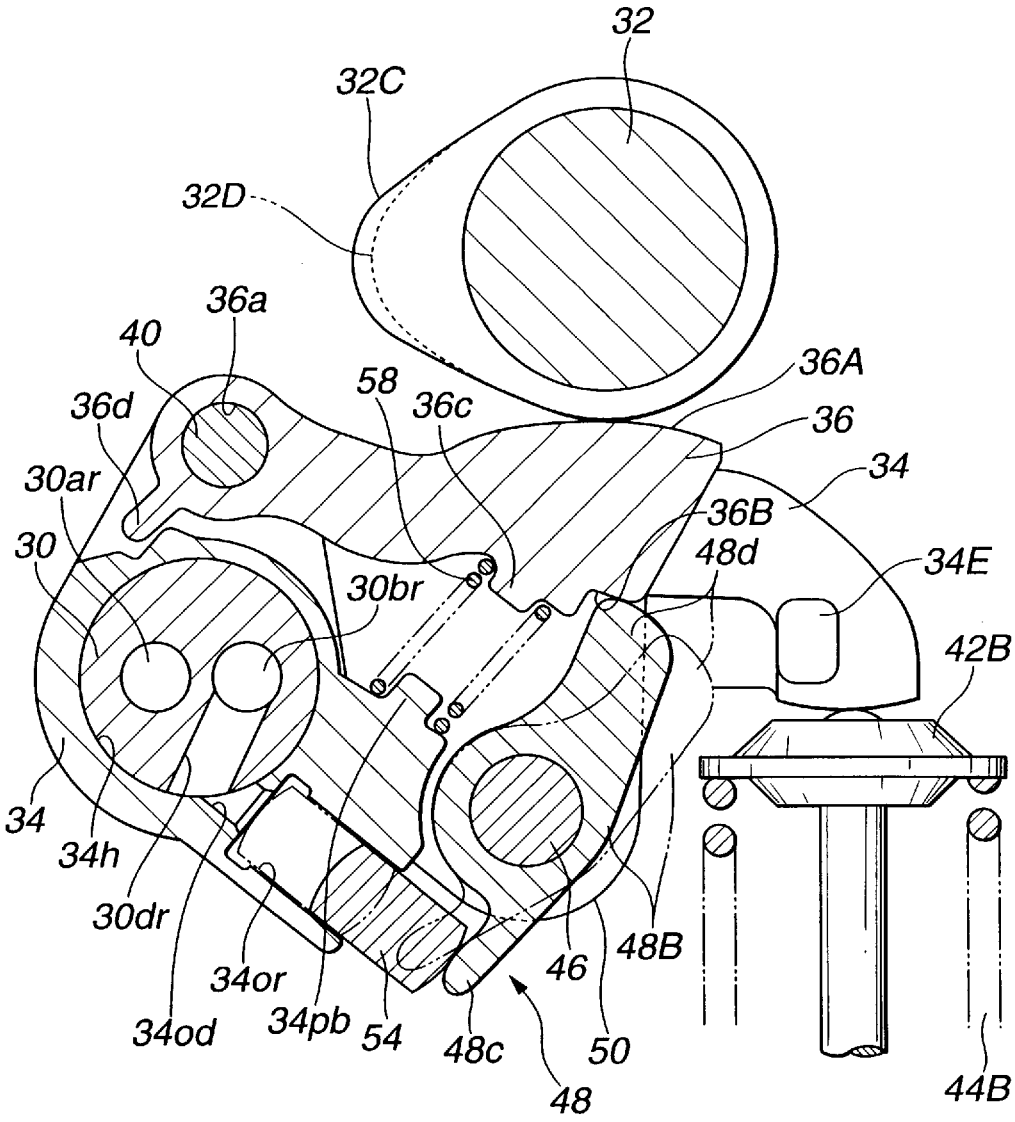
FIG. 7 is a view similar to FIG. 5, but showing a different condition of the valve operating device.

As is seen from FIG. 7, when the hydraulic work chamber 34*or* is fed with a certain hydraulic pressure through the hydraulic passages 30*dr* and 34*od*, the piston 54 is projected outward through an open end of the work chamber 34*or*. With this, a downward projection 48*c* of the engaging portion 48B of the connecting lever 48 is pushed rightward in the drawing pivoting the connecting lever 48 in a counterclockwise direction against the force of the return spring 50, that is, in a direction to cause the top end 48*d* of the engaging portion 48B to near the high speed sub-rocker arm 36.

While, when the hydraulic pressure is discharged from the hydraulic work chamber 34*or*, the piston 54 is retracted into the work chamber 34*or* due to the force of the return spring 50. That is, in this case, the connecting lever 48 is pivoted in a counterclockwise direction in FIG. 5, that is, in a direction to move the top end 48*d* of the engaging portion 48B away from the high speed sub-rocker arm 36.

As is shown in FIG. 2, for feeding the above-mentioned hydraulic work chambers 34*r* and 34*or* with a given hydraulic pressure, there is provided a hydraulic pressure producing unit 72. The hydraulic pressure producing unit 72 is controlled by an engine control unit 70 in accordance with the operation condition of the engine 4. In fact, the valve lifting control, valve stopping control and ignition timing control are all carried out by the engine control unit 70.

The hydraulic pressure producing unit 72 comprises generally a plurality of hydraulic passages whose one ends are connected to an outlet side of an oil pump and a plurality of electromagnetic valves respectively installed in the hydraulic passages. The other ends of the hydraulic passages are respectively connected to hydraulic passages defined in the engine 4, and the oil pump is operated to pump up the hydraulic fluid in an oil pan of the engine 4.

The hydraulic passages are grouped into two which are independent from each other. That is, for example, one group is applied to the hydraulic passages 30*ar* and 30*br* which are provided for only the cylinders 6B and 6C, and the other group is applied to the hydraulic passages 30*ar* and 30*br* which are provided for only the other cylinders 6A and 6D.

Upon receiving an instruction signal from the engine control unit 70, each electromagnetic valve functions to feed the hydraulic work chamber 34*r* or 34*or* with an adjusted hydraulic pressure.

Inputted into the engine control unit 70 are an engine speed signal S*n* produced by an engine speed sensor 16 mounted to the distributor 12, a crank angle signal S*c* produced by a crank angle sensor 18 mounted to the distributor 12, a cooling water temperature signal S*w* produced by a temperature sensor 17 installed in a cooling water jacket of the engine 4, a throttle angle signal S*t* produced by a throttle angle sensor 20 which senses the opening angle of the throttle valve 19, an intake air rate signal S*a* produced by an air flow meter and an intake negative pressure signal S*b* produced by an intake pressure sensor.

In the engine control unit 70, based on the engine speed signal S*n* and the intake negative pressure signal S*b*, a reference spark-advance value is determined, based on the cooling water temperature signal S*w*, a correction value for the spark-advance value is determined, and based on the reference spark-advance value and the correction value, an effective spark-advance value is determined. Furthermore, in the engine control unit 70, in accordance with the crank angle signal S*c* and the determined effective spark-advance value, an ignition timing control signal C*i* is produced and led into the ignition control unit 14. With this, as has been mentioned hereinabove, at first, ignition is carried out in the cylinder 6A, then in the cylinder 6C, then in the cylinder 6B and then in the cylinder 6D.

In the valve lift degree switching control, based on the engine speed signal S*n* and the throttle angle signal S*t*, or the intake air rate signal S*a* and the cooling water temperature signal S*w*, the engine control unit 70 stops feeding of hydraulic pressure to the hydraulic passages 30*ar* and 30*br* of all of the cylinders 6A, 6B, 6C and 6D at the time of engine starting. Thus, as is seen from FIG. 6, at the engine starting, the piston 52 takes its projected position causing the engaging portion 48A of the connecting lever 48 to operatively engage with the recess 38B of the low speed sub-rocker arm 38. While, as is seen from FIG. 5, at this engine starting, the piston 54 assumes its retracted position causing the other engaging portion 48B of the connecting lever 48 to be released from the corresponding recess 36B.

Figure 6:
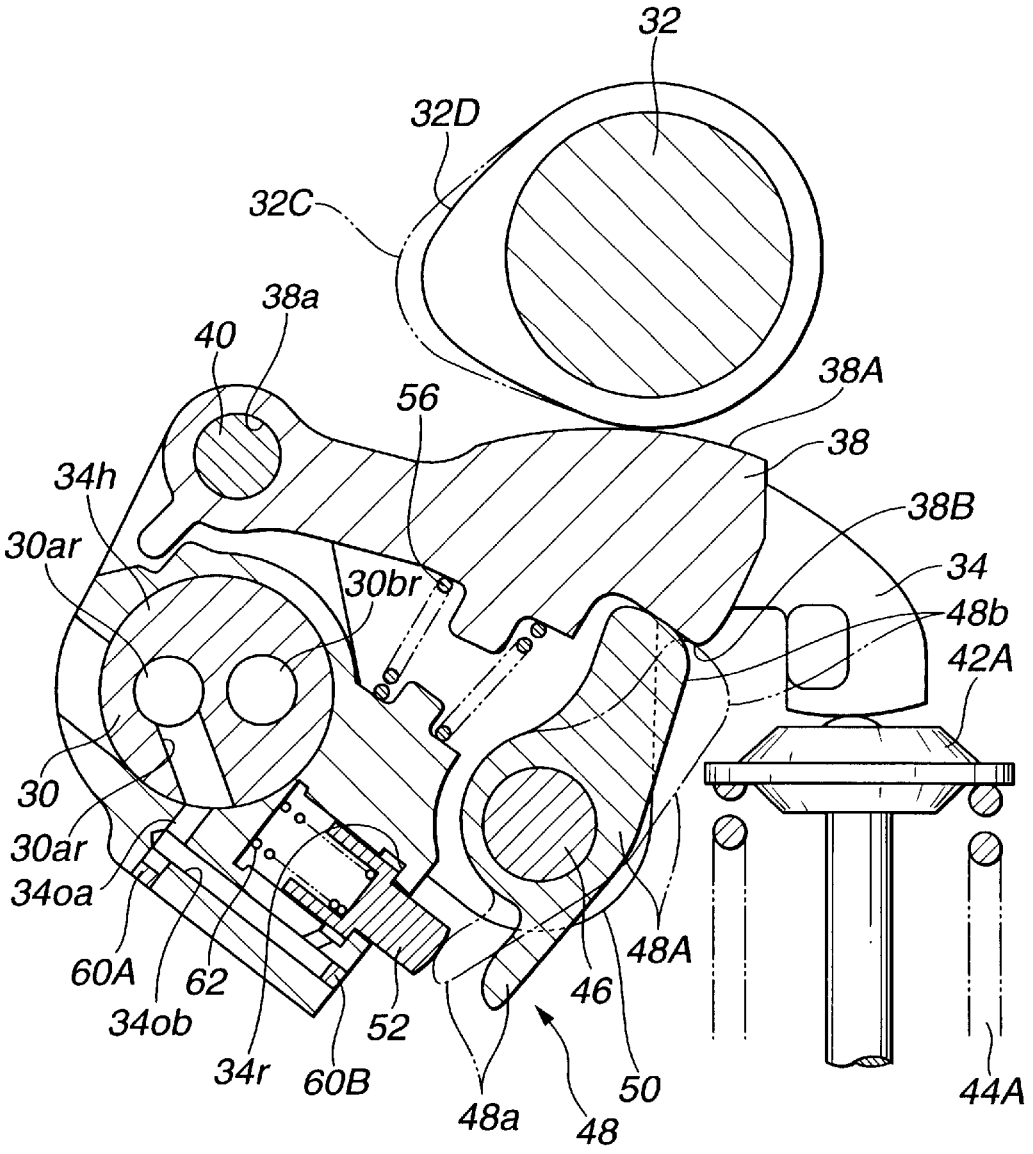
FIG. 6 is a view similar to FIG. 1, but showing a different condition of the valve operating device.

That is, in this case, the engaging portion 48A becomes operative and thus, the main rocker arm 34 is actuated by the low speed cam 32D, as is shown in FIG. 6. Thus, the opening/closing operation of the intake valves 42A and 42B is timed by the low speed cam 32D. Accordingly, the engine starting is smoothly and assuredly carried out.

Furthermore, based on the engine speed signal S*n* and the throttle angle signal S*t* or the intake air rate signal S*a* and the cooling water temperature signal S*w*, the engine control unit 70 stops feeding of hydraulic pressure to the hydraulic passages 30*ar* and 30*br* of all of the cylinders 6A, 6B, 6C and 6D when the engine 4 runs at a lower speed (viz., lower than 5,000 rpm) in a medium to high load. Under this low speed operation condition of the engine 4, only the engaging portion 48A of the connecting lever 48 becomes operative for the reason as has been mentioned in the section of engine starting. Thus, the opening/closing operation of the intake valves 42A and 42B is timed by the low speed cam 32D.

Furthermore, based on the engine speed signal S*n* and the throttle angle signal S*t* or the intake air rate signal S*a* and the cooling water temperature signal S*w*, the engine control unit 70 carries out feeding of hydraulic pressure to only the hydraulic work chambers 34*or* of all of the cylinders 6A, 6B, 6C and 6D through the hydraulic passages 30*br* when the engine 4 runs at a higher speed (viz., 5,000 rpm to 8,000 rpm) in a medium to high load. In fact, for feeding the hydraulic pressure to the hydraulic work chambers 34*or*, the hydraulic pressure producing unit 72 receives a corresponding instruction signal C*db* from the engine control unit 70.

As is seen from FIG. 7, upon supply of hydraulic pressure to the hydraulic work chamber 34*or* through the hydraulic passage 30*br*, the piston 54 is shifted to take its projected position, and thus, the engaging portion 48B of the connecting lever 48 is brought into engagement with the recess 36B of the high speed sub-rocker arm 36. While, as is seen from FIG. 6, because the hydraulic work chamber 34*r* is not fed with hydraulic pressure, the piston 52 keeps its projected position, and thus the engagement between the engaging portion 48A of the connecting lever 48 and the recess 38B of the low speed sub-rocker arm 38 is kept. That is, in this condition, both the engaging portions 48B and 48A of the connecting lever 48 are engaged with the corresponding recesses 36B and 38B of the high and low speed sub-rocker arms 36 and 38, respectively. That is, both the sub-rocker arms 36 and 38 are fixed to the main rocker arm 34 to act as a single unit.

Accordingly, as is understood from FIG. 7, the main rocker arm 34 is actuated by the high speed cam 32C. That is, the opening/closing operation of the intake valves 42A and 42B is timed by the high speed cam 32C. As is seen from this drawing, the construction of the high speed cam 32C is the same as that of the low speed cam 32D except the radially projected cam portion, and the radially projected cam portion of the high speed cam 32C is higher than that of the low speed cam 32D. Thus, the pivoting movement of the rocker cam 34 is effected by only the high speed cam 32C that slidably contacts the cam follower 36A of the high speed sub-rocker arm 36. In other words, rotation of the low speed cam 32D has substantially no effect on the pivoting movement of the rocker cam 34.

In the valve stopping control, based on the engine speed signal S*n* and the throttle angle signal S*t*, or the intake air rate signal S*a* and the cooling water temperature signal S*w*, the engine control unit 70 carries out feeding of hydraulic pressure to only the hydraulic passages 30*ar* of the cylinders 6B and 6C when the engine 4 runs at a lower speed (viz., 750 rpm to 3,000 rpm) in idling or low load. In fact, for feeding the hydraulic pressure to only the hydraulic passages 30*ar* of the cylinders 6B and 6C, the hydraulic pressure producing unit 72 receives a corresponding instruction signal C*da* from the engine control unit 70. It is now to be noted that in this condition, the engine control unit 70 does not feed the hydraulic pressure to the hydraulic passages 30*ar* of the other cylinders 6A and 6D.

Accordingly, as is understood from FIG. 1, the hydraulic work chambers 34*r* for the cylinders 6B and 6C are fed with hydraulic pressure through the hydraulic passages 30*ar*, while, as is understood from FIG. 5, the hydraulic work chambers 34*or* for the cylinders 6B and 6C are not fed with hydraulic pressure. Thus, both the piston 52 (see FIG. 1) and piston 54 (see FIG. 5) take their retracted positions. Accordingly, as is seen from these drawings, both the engaging portions 48A and 48B of the connecting lever 48 are released from the corresponding recesses 38B and 36B of the low and high speed sub-rocker arms 38 and 36. Thus, under this valve stopping control, these low and high speed sub-rocker arms 38 and 36 are freely pivotal about the supporting shaft 40 relative to the main rocker arm 34. Thus, the intake valves 42A and 42B of the cylinders 6B and 6C assume their rest condition, which can reduce a pumping loss of the engine 4.

As is described hereinabove, under this condition, the low and high speed sub-rocker arms 38 and 36 freely pivot relative to the main rocker arm 34. Thus, pivoting movement of the low speed sub-rocker arm 38 induced by rotation of the low speed cam 32D (see FIG. 1) is absorbed by the coil spring 56, and pivoting movement of the high speed sub-rocker arm 36 induced by rotation of the high speed cam 32C (see FIG. 5) is absorbed by the coil spring 58.

During this operation, the hydraulic passages 30*ar* and 30*br* for the cylinders 6A and 6D are not fed with hydraulic pressure. Thus, the piston 52 for each of these cylinders 6A and 6D assumes the projected position (see FIG. 6) causing the engaging portion 48A of the connecting lever 48 to engage with the recess 38B of the low speed sub-rocker arm 38, while the piston 54 for each of the cylinders 6A and 6D assumes its retracted position (see FIG. 5) causing the engaging portion 48B of the connecting lever 48 to release from the recess 36B of the high speed sub-rocker arm 36. That is, under this condition, only the low speed sub-rocker arm 38 for each of the cylinders 6A and 6D is fixed to the main rocker arm 34 to act as a single unit. Thus, the opening/closing operation of the intake valves 42A and 42B for the cylinders 6A and 6D is timed by the low speed cam 32D.

As will be understood from the foregoing description, first, second and third operation modes are provided by the valve operating device. That is, in the first operation mode, both of the low speed sub-rocker arm 38 and the high speed sub-rocker arm 36 are disengaged from the main rocker arm 34. Thus, in this case, the main rocker arm 34 does not operate and thus the intake valves 42A and 42B assume their rest condition, which can reduce a pumping loss of the engine 4. In the second operation mode, only the low speed sub-rocker arm 38 is fixed to the main rocker arm 34. Thus, in this case, the intake valves 42A and 42B are controlled by the low speed cam 32D through the main rocker arm 34. In the third operation mode, both the low and high speed sub-rocker arms 38 and 36 are fixed to the main rocker arm 34. Thus, in this case, the intake valves 42A and 42B are controlled by the high speed cam 42C through the rocker cam 34.

Furthermore, in the present invention, the second operation mode (which is achieved when only the low speed sub-rocker arm 38 is fixed to the main rocker arm 34) is carried out when the hydraulic pressure is discharged from the hydraulic work chamber 34*r*. This brings about the following advantage. That is, when the engine 4 is stopped, the feeding of hydraulic pressure to the work chamber 34*r* is also stopped. Thus, upon stopping the engine 4, the second operation mode, that is, the fixing between the low speed sub-rocker arm 38 and the main rocker arm 34, is instantly assumed by the valve operating device. Thus, subsequent engine starting is smoothly carried out.

Although, in the above-mentioned embodiment, for coupling each of the sub-rocker arms 36 and 38 with the main rocker arm 34, the arrangement using the connecting lever 48 pivotally supported on the main rocker arm 34 is employed, other arrangements such as those disclosed in U.S. Pat. Nos. 6,125,805 and 5,445,115 may be employed which uses a non-pivotal connecting member.

The entire contents of Japanese Patent Applications 11338017 (filed Nov. 29, 1999) are incorporated herein by reference.

Although the invention has been described above with reference to the embodiment of the invention, the invention is not limited to the embodiment described above. Various modifications and variations of the embodiment described above will occur to those skilled in the art, in light of the above teachings.

What is claimed is:

1. A valve operating device of an internal combustion engine, comprising:

low and high speed cams coaxially disposed on a cam shaft, said low speed cam having a lobe that is lower than that of said high speed cam;

a main rocker arm pivotally supported by a rocker shaft and operatively contacting an intake or exhaust valve of the engine to actuate the same;

first and second sub-rocker arms pivotally supported by said main rocker arm and pivotally actuated by said low and high speed cams respectively;

a connecting member supported by said main rocker arm, said connecting member comprising first and second engaging portions which are respectively engageable with first and second engaged portions defined by said first and second sub-rocker arms, so that upon engagement of said first engaging portion with said first engaged portion, said first sub-rocker arm and said main rocker arm become fixed to each other to pivot about said rocker shaft like a single unit, and upon engagement of said second engaging portion with said second engaged portion, said second sub-rocker arm and said main rocker arm become fixed to each other to pivot about said rocker shaft like a single unit;

a hydraulically actuating mechanism comprising first and second hydraulic work chambers, said mechanism inducing the engagement between said first engaging portion and said first engaged portion upon discharge of hydraulic fluid from said first work chamber and inducing a disengagement between said first engaging portion and said first engaged portion upon feeding of the hydraulic fluid into said first work chamber, and said mechanism selectively inducing the engagement or disengagement between said second engaging portion and said second engaged portion in accordance with a pressure of hydraulic fluid fed to said second work chamber;

a hydraulic pressure producing unit that feeds said first and second work chambers with hydraulic pressure respectively; and a control unit that, in accordance with operation condition of the engine, controls said hydraulic pressure producing unit, so that said hydraulically actuating mechanism has at least first, second and third operation modes, said first mode being a mode wherein disengagement takes place both between said first engaging portion and said first engaged portion and between said second engaging portion and said second engaged portion, said second mode being a mode wherein engagement takes place between said first engaging portion and said first engaged portion and disengagement takes place between said second engaging portion and said second engaged portion, said third mode being a mode wherein engagement takes place both between said first engaging portion and said first engaged portion and between said second engaging portion and said second engaged portion, in which said hydraulically actuating mechanism further comprises first and second pistons which are operatively received in said first and second hydraulic work chambers, said first piston bringing said first engaging portion into engagement with said first engaged portion when assuming its projected position in response to discharge of hydraulic fluid from said first work chamber and said second piston bringing said second engaging portion into engagement with said second engaged portion when assuming its projected position in response to feeding of hydraulic fluid into said second work chamber, and in which a biasing spring is disposed in said first work chamber to bias said first piston toward the projected position.

2. A valve operating mechanism as claimed in claim 1, in which said first piston has a shoulder portion to which the hydraulic pressure in the first work chamber is applied to move the first piston to its retracted position against the force of said biasing spring upon feeding of hydraulic fluid into said first work chamber, and in which said second piston is moved to its projected position upon feeding of hydraulic pressure to said second work chamber.

3. A valve operating device as claimed in claim 2, in which said first and second pistons are positioned beside said rocker shaft and arranged in parallel with each other.

4. A valve operating device as claimed in claim 2, in which said first work chamber is formed with an annular groove from which hydraulic fluid is fed to said first work chamber.

5. A valve operating device as claimed in claim 1, in which each of said first and second pistons has a rounded exposed end to which a portion of said first or second sub-rocker arm contacts.

6. A valve operating device as claimed in claim 1, in which said control unit controls said hydraulic pressure producing unit in such a manner when the engine stops, engagement takes place between said first engaging portion and said first engaged portion and disengagement takes place between said second engaging portion and said second engaged portion.

7. A valve operating device as claimed in claim 1, in which said connecting member is a lever which is pivotally connected to said main rocker arm through a supporting shaft.

8. A valve operating device as claimed in claim 7, in which said connecting member is constructed and arranged so that when said connecting member pivots in an engaging direction, engagement of said first engaging portion with said first engaged portion takes place earlier than engagement of said second engaging portion with said second engaged portion.

9. A valve operating device as claimed in claim 7, in which said connecting member is biased by a return spring to pivot in such a direction that said first and second engaging portions move away from said first and second engaged portions.

10. A valve operating device as claimed in claim 9, in which the force produced by said biasing spring in the first work chamber is greater than that of said return spring of said connecting member.

11. A valve operating device as claimed in claim 1, in which said first and second work chambers are fluidly connected to said hydraulic pressure producing unit through respective fluid passages.

12. A valve operating device as claimed in claim 1, in which when the engine runs at a lower speed in a medium to high load condition, said control unit causes said hydraulic actuating mechanism to take said second operation mode.

13. A valve operating device as claimed in claim 1, in which when the engine runs at a higher speed in a medium to high load condition, said control unit causes said hydraulic actuating mechanism to take said third operation mode.

14. A valve operating device as claimed in claim 1, in which when the engine runs at a lower speed in idling or low load condition, said control unit causes said hydraulic actuating mechanism to take said first operation mode.

15. A valve operating device as claimed in claim 1, in which said first and second sub-rocker arms are pivotally connected to said main rocker arm through a common supporting shaft.

16. A valve operating device as claimed in claim 1, in which said main rocker arm comprises:

two arm portions having at leading ends thereof contacting portions which are contactable with upper ends of valves; and a connecting portion by which said contacting portions of the two arm portions are integrally connected.

17. A valve operating device of an internal combustion engine, comprising:

a plurality of cams coaxially disposed on a cam shaft, one of said cam being a low speed cam;

a rocker arm pivotally supported by a rocker shaft and operatively contacting an intake or exhaust valve of the engine to actuate the same;

a sub-rocker arm pivotally supported by said rocker shaft and pivotally actuated by said low speed cam;

a connecting member supported by said main rocker arm, said connecting member having both a first condition wherein said sub-rocker arm and said main rocker arm are fixed to each other to constitute a single unit and a second condition wherein said sub-rocker arm and said main rocker arm are disengaged from each other;

a hydraulically actuating mechanism including a hydraulic work chamber, said mechanism inducing said first condition of said connecting member upon discharge of hydraulic fluid from said work chamber and inducing said second condition upon feeding of hydraulic fluid to said work chamber; and a control unit that causes said hydraulically actuating mechanism to induce said first condition of the connecting member when the engine stops.

18. A valve operating device of an internal combustion engine, comprising:

at least one cam disposed on a cam shaft;

a rocker arm pivotally supported by a rocker shaft and operatively contacting an intake or exhaust valve of a cylinder of the engine to actuate the same;

a sub-rocker arm pivotally supported by said main rocker arm and pivotally actuated by said cam;

a connecting member supported by said main rocker arm, said connecting member having both a first condition wherein said sub-rocker arm and said main rocker arm are fixed to each other to pivot about said rocker shaft like a single unit and a second condition wherein said sub-rocker arm and said main rocker arm are disengaged from each other to fail to transmit a pivotal movement of said sub-rocker arm induced by rotation of said cam to said main rocker arm thereby to stop operation of said intake or exhaust valve;

a hydraulically actuating mechanism including a hydraulic work chamber, said mechanism inducing said first condition of said connecting member upon discharge of hydraulic fluid from said work chamber and inducing said second condition upon feeding of hydraulic fluid to said work chamber; and a control unit that causes said hydraulic actuating mechanism to induce said first condition of the connecting member when the engine stops.

* * * * *